United States Patent [19]

Osborne

[11] Patent Number: 5,000,244

[45] Date of Patent: Mar. 19, 1991

[54] LOST FOAM CASTING OF DUAL ALLOY ENGINE BLOCK

[75] Inventor: Richard J. Osborne, Utica, Mich.

[73] Assignee: General Motors Corporation, Detroit, Mich.

[21] Appl. No.: 445,205

[22] Filed: Dec. 4, 1989

[51] Int. Cl.[5] ..... B22C 9/04; B22D 19/16

[52] U.S. Cl. ..... 164/34; 164/91; 164/95; 164/96

[58] Field of Search ..... 164/34, 93, 94, 95, 164/96, 91

[56] References Cited

U.S. PATENT DOCUMENTS

| | | | |
|---|---|---|---|
| 3,861,454 | 1/1975 | Mezey | 164/34 X |
| 4,197,899 | 4/1980 | Ernest | 164/34 |
| 4,243,093 | 1/1981 | Nieman | 164/96 |

FOREIGN PATENT DOCUMENTS

| | | | |
|---|---|---|---|
| 63-2548 | 1/1988 | Japan | 164/95 |
| 64-27763 | 1/1989 | Japan | 164/34 |
| WO89/02326 | 3/1989 | PCT Int'l Appl. | 164/34 |

*Primary Examiner*—Richard K. Seidel
*Assistant Examiner*—J. Reed Batten, Jr.
*Attorney, Agent, or Firm*—Douglas D. Fekete

[57] ABSTRACT

In a preferred embodiment, a compound aluminium alloy engine block casting comprises at least a piston-travel region of a cylinder wall section formed of a first alloy, preferably hypereutectic aluminum-silicon alloy, and a remainder including a crankcase section and a water jacket wall formed of a distinct second alloy, preferably hypoeutectic aluminum-silicon alloy. The engine block casting is made by a lost foam process that employs an expendable pattern formed of expanded polystyrene or the like. The pattern comprises a first runner system for casting the first alloy to decompose and replace a portion of the pattern corresponding to the piston-travel region of the casting, and a second runner system for casting the second alloy to decompose and replace the remainder of the pattern. The first alloy and the second alloy are independently but concurrently cast into a singular mold, such that the entire pattern is duplicated, whereupon the alloys merge and fuse to form an integral casting. The preferred product engine block casting advantageously combines the high wear resistance of the hypereutectic aluminum alloy in the cylinder wall section and the reduced porosity and improved machinability of the hypoeutectic alloy throughout the balance of the casting.

3 Claims, 3 Drawing Sheets

LOST FOAM CASTING OF DUAL ALLOY ENGINE BLOCK

BACKGROUND OF THE INVENTION

This invention relates to a lost foam metal casting process that comprises independently and concurrently casting two metal alloys to form an integral body. More particularly, this invention relates to a lost foam engine block casting comprising distinct sections formed of different aluminum alloys that are concurrently cast to fuse the alloys into an integral product.

In a typical lost foam casting process, a pattern is formed of a polymeric material vaporizable at metal casting temperatures, such as molded expanded polystyrene. The pattern is embedded in an unbonded sand body to form a foundry mold. Molten metal is cast into the mold in contact with the pattern, whereupon the metal progressively decomposes and replaces the pattern. In this manner, the pattern is duplicated by the metal, whereafter the metal solidifies to form a product casting.

A common internal combustion engine of the type employed to power automotive vehicles comprises an engine block formed of a relatively massive and complex metal casting. Depending upon the particular engine design, the engine block casting comprises one or more walls that define a desired number of cylinder bores. During engine operation, a piston reciprocates within each bore to drive a common crankshaft. The crankshaft is housed within a crankcase formed at least in part by a section of the engine block casting. Also, the engine block casting comprises an outer wall located about the cylinder walls, but spaced apart therefrom to define a water jacket through which coolant is circulated during engine operation. Thus, the engine block is formed of a single casting that comprises a cylinder wall section, a crankcase section and a water jacket wall section.

Although historically most engine blocks have been formed of cast iron, engine blocks have also been formed of aluminum castings. Aluminum blocks have been cast by empty-cavity processes such as die casting or permanent mold casting. It has also been proposed to cast aluminum blocks by a lost form process. Aluminum alloys of the type used in engine blocks have properties dependent upon the silicon content and are described by reference to a low melting eutectic composition formed between aluminum and about 12 percent silicon. Hypereutectic alloys contain silicon in an amount greater than the eutectic and are characterized by the presence of free silicon particles dispersed in a eutectic matrix. The free silicon particles form a hard phase that improves wear resistance. This wear resistance is desired in the bore wall to reduce scuffing by the piston. However, hypereutectic alloys are more difficult to cast, particularly in a large body such as an engine block. Early precipitation of the silicon particles hinders the flow of feed metal into slow solidifying, interior regions of the casting, resulting in increased macroporosity. Also, hypereutectic alloys exhibit increased microporosity attributed to added heat released during silicon precipitation and increased thermal contraction during cooling. Although desired for cylinder walls, the hypereutectic alloy renders the casting more difficult to machine, as evidenced by increased tool wear, and is not considered advantageous in sections remote from the cylinder wall. Of particular significance to this invention, the casting of hypereutectic alloy by a lost foam process presents difficulties peculiar to that process. Loss of heat at the melt front adjacent the decomposing pattern results in premature solidification, as evidenced by cold fold defects in the product casting.

On the other hand, hypoeutectic alloys, which contain less silicon than the eutectic, are characterized by dispersed aluminum particles that are soft in contrast to the hard silicon particles in the hypereutectic alloy. This facilitates machining of the casting, but also increases wear at the bore wall. It is known to insert a tubular liner formed of wear-resistant alloys, such as cast iron or hypereutectic aluminum alloy, into cylinder bores in the hypoeutectic casting to provide a satisfactory piston contact surface. Liners require precision machining of both inner diameter and outer diameter surfaces and careful assembling into the engine block to obtain a proper fit, thereby adding significantly to the cost of the engine. Also, depending upon engine design, stresses created by differential thermal expansion between the liner and the surrounding cylinder wall may result in crack formation during engine operation.

For these reasons, engine block castings formed solely of hypereutectic alloy or formed solely of hypoeutectic alloy have not been entirely satisfactory.

It is an object of this invention to provide an integral casting formed by a lost foam process and comprising a first section formed of a first alloy and an independently but concurrently cast second section formed of a second alloy compositionally distinct from the first alloy.

It is a more particular object of this invention to provide a compound aluminum alloy engine block casting comprising a cylinder bore wall section formed of a first alloy, preferably hypereutectic aluminum alloy, and a remainder formed of a second alloy compositionally distinct from the first alloy, preferably hypoeutectic aluminum alloy.

It is also an object of this invention to provide a lost foam process for casting metal which comprises providing an expendable pattern having portions corresponding to sections in the product, and casting a first alloy to replace a first portion of the pattern and a compositionally distinct second alloy to replace a second portion of the pattern, such that the resulting integral product comprises a first section formed of the first alloy and a second section formed of the second alloy.

It is a more particular object of this invention to provide a lost foam casting process for producing an engine block casting from a pattern sized and shaped corresponding to the desired engine block configuration, which process comprises casting a melt of a hypereutectic alloy to duplicate a portion of the pattern corresponding to an engine wall section of the engine block casting and independently casting a hypoeutectic alloy to replace portions of the pattern corresponding to the crankcase section and the water jacket wall section.

SUMMARY OF THE INVENTION

In a preferred embodiment, these and other objects are accomplished by a lost foam casting process for producing a compound aluminum alloy engine block casting that comprises a cylinder wall section formed of a hypereutectic aluminum alloy and crankcase section and a water jacket wall section formed of hypoeutectic aluminum alloy. The process utilizes an expendable pattern comprising a product portion sized and shaped corresponding to the desired engine block casting configuration. The engine block pattern comprises portions corresponding to a crankcase section, a cylinder wall section and a water jacket wall section in the engine block casting. The pattern comprises a first runner system having a melt pour surface. The first runner system is connected to the cylinder wall portion of the pattern for conveying molten metal from the melt pour surface to the cylinder wall portion. The pattern further comprises a second runner system having a melt pour surface independent from the first runner melt pour surface. The second runner system is connected to the water jacket wall portion at one or more regions spaced apart from the cylinder wall portion and is adapted for conveying molten metal from the second runner melt pour surface to the cylinder wall portion. The pattern is formed by assembling, using a vaporizable adhesive, individually molded portions formed of expanded polystyrene or the like. The assembled pattern is embedded in a body of unbonded sand particles to produce a mold. The pattern is arranged in the mold such that the first runner melt pour surface and the second runner melt pour surface are exposed and spaced apart for independent contact with cast metal.

In accordance with this invention, a first charge of molten hypereutectic aluminum-silicon alloy is cast into contact with the first runner melt pour surface. Upon contact with the pattern, the molten metal progressively decomposes and replaces the first runner system and thereafter the cylinder wall portion of the pattern. A second charge of a hypoeutectic alloy is cast against the second runner melt pour surface, whereupon the charge progressively decomposes and replaces the second melt runner system and thereafter the water jacket wall portion and crankcase portion of the engine block pattern. Eventually, the entire product pattern portion is consumed and replaced, whereupon the two charges flow together and fuse to produce an integral casting. The two molten charges are cast concurrently, by which is meant that the charges are cast simultaneously or, if cast successively, are cast in such close succession, for example a few seconds, that the latter cast charge is poured before the earlier cast charge is solidified. The line of fusion at which the charges flow together is determined by the relative volumes of the charges. In a preferred embodiment, the volume of cast hypereutectic alloy is sufficient to replace a region of the cylinder wall over which the piston travels during engine operation. The melt front for the hypereutectic alloy thus terminates at a line proximate to the crankcase section. The volume of hypoeutectic charge is sufficient to replace the balance of the pattern, whereupon the hypoeutectic alloy front flows against the hypereutectic front to fuse the independent charges into a single product casting. Following solidification of the dual cast alloys, the product engine block casting is removed from the mold and separated from the runner systems.

Therefore, the engine block casting of this invention thus comprises a cylinder wall section formed of hypereutectic aluminum-silicon alloy and a remainder, including the water jacket wall and the crankcase section, formed of hypoeutectic aluminum-silicon alloy. Thus, this invention provides the wear resistance advantages of the hypereutectic alloy in the critical region of the cylinder wall section without the disadvantages of high porosity, cold folds and reduced machinability within more massive regions of the casting, and at the same time produces a sound casting throughout the crankcase section and the water jacket wall section of hypoeutectic alloy which may be readily machined to drill and tap holes and finish other features in the engine block, without suffering the disadvantages of a soft cylinder bore wall that would otherwise necessitate cylinder liners at additional cost. Furthermore, the process of this invention may be readily carried out in a single mold to produce a single product casting, thereby reducing the cost of the product engine block.

DESCRIPTION OF THE DRAWINGS

This invention will be further illustrated with reference to the figures wherein.

DETAILED DESCRIPTION OF THE INVENTION

Figure 5:
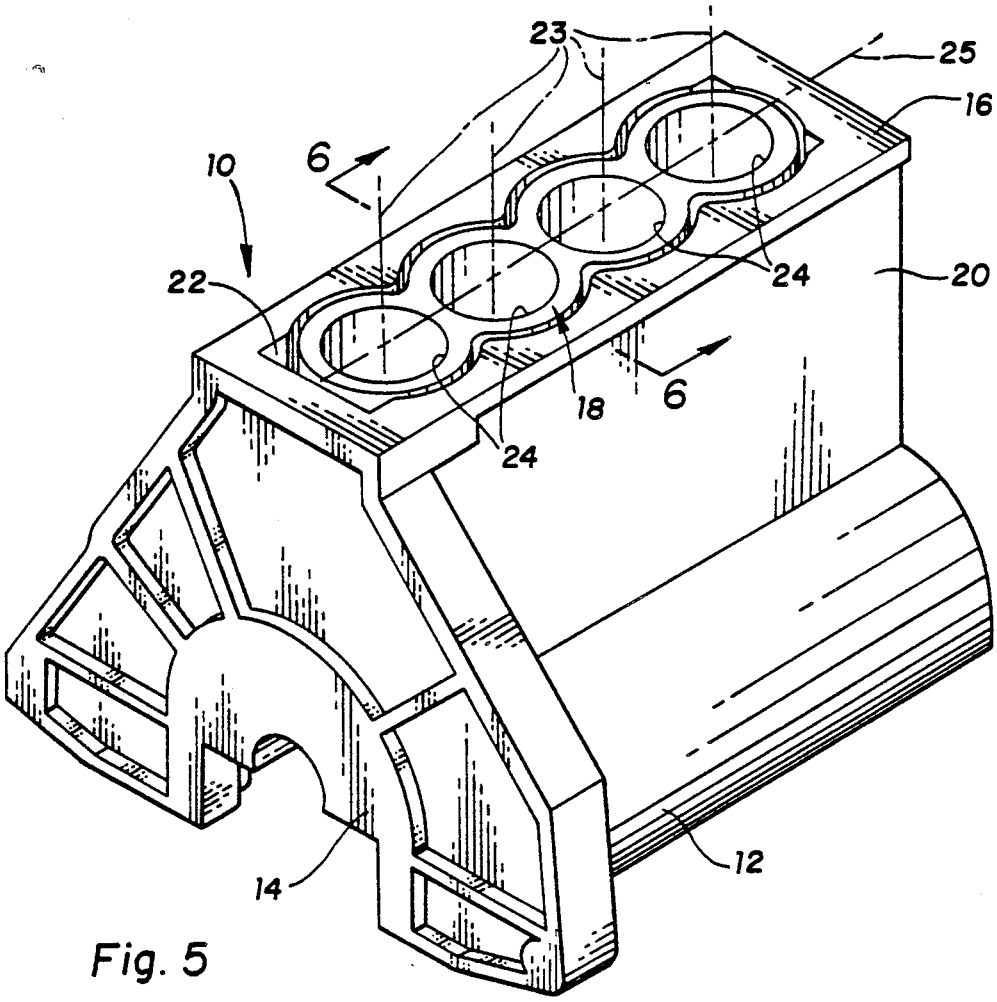
FIG. 5 is a perspective view of a preferred dual aluminum alloy engine block casting of this invention.
Figure 6:
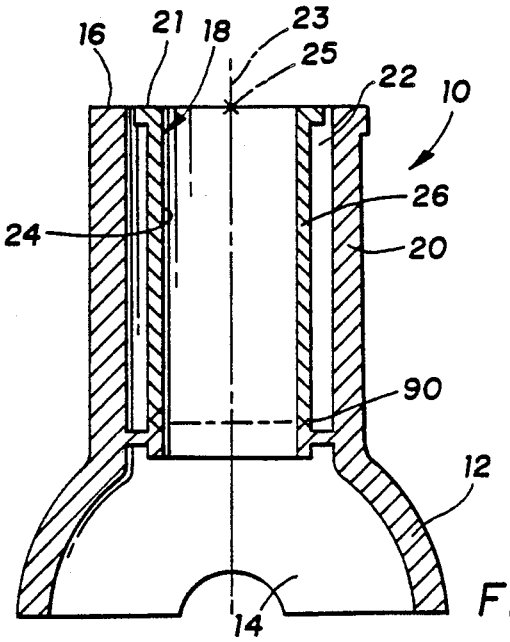
FIG. 6 is a cross-sectional view of the engine block casting in FIG. 5 taken along line 6—6 and looking in the direction of the arrows.

In a preferred embodiment of this invention, a compound aluminum alloy engine block casting is cast by a lost foam process. Referring to FIGS. 5 and 6, there is depicted an engine block casting 10 for an automotive L-4 spark-ignition engine. Engine block casting 10, shown in an upright orientation, comprises a base crankcase section 12 that defines a portion of the crankcase and includes crankshaft bearing supports 14 and a cylinder head deck 16 opposite crankcase section 12. Extending between crankcase section 12 and deck 16 are a cylinder wall section 18 and an outer water jacket wall 20, which are spaced apart to define a water jacket 22 through which coolant is circulated during engine operation. In this example, cylinder wall 18 defines four parallel cylinder bores 24 that extend from deck 16 to crankcase 12 and are aligned along centerline 25 such that each cylinder bore center axis 23 perpendicularly intersects centerline 25. In this example, the cylinder bores are arranged in a Siamese fashion; that is, adjacent bores are separated by a common wall. One consequence of this Siamese arrangement is that all four bores 24 are defined by a single continuous wall. However, this invention is also suitable for casting an engine block having cylinder walls defined by distinct tubular walls spaced apart by water coolant passages. Each bore 24 is adapted to receive a piston of the engine and includes an end 21 at cylinder head deck 16 and including a region 26 over which the piston reciprocally travels during engine operation. In accordance with this invention, at least the piston-travel subsection 26 is cast of a wear-resistant alloy compositionally different from crankcase section 12 and water jacket wall 20.

Figure 1:
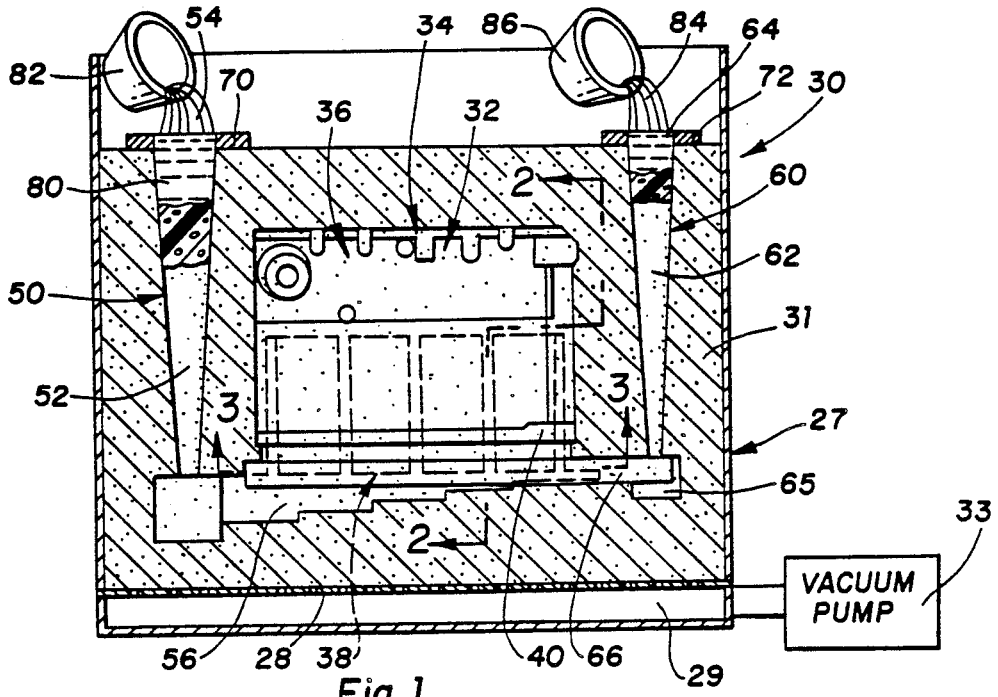
FIG. 1 is a cross-sectional view of a foundry mold comprising an expendable polymeric engine block pattern for casting by a lost foam process.
Figure 2:
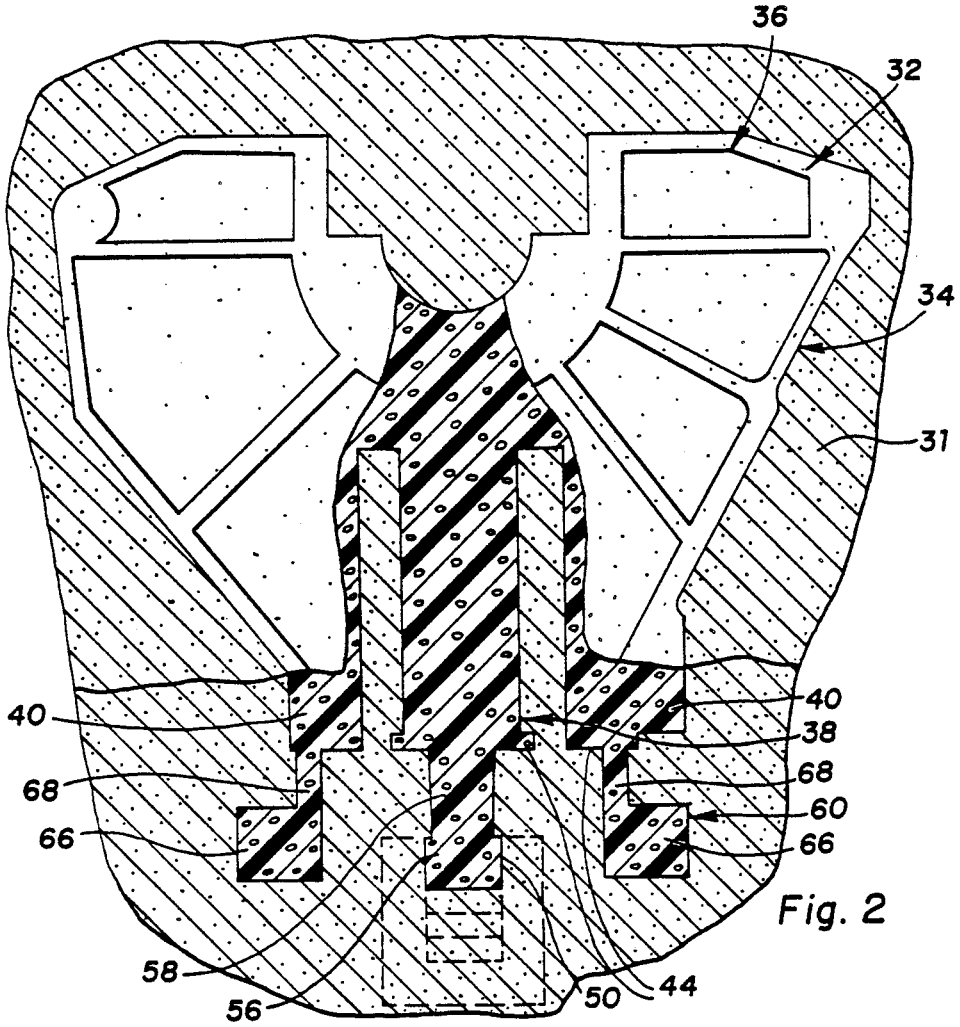
FIG. 2 is a cross-sectional view, partially cut away, of the mold in FIG. 1 taken along the lines 2—2 and looking in the direction of the arrows.

Referring to FIG. 1, there is shown a foundry mold 30 for the lost foam casting of engine block casting 10. Mold 30 comprises a body 31 of unbonded lake sand particles packed about a pattern 32 composed of expanded polystyrene material thermally decomposable at aluminum casting temperatures. Sand body 31 is contained within a flask 27 supported by perforated lower wall 28. Flask 27 comprises a plenum 29 opposite perforated wall 28 from sand body 31 and connected to an external vacuum pump 33. Perforated wall 28 retains the sand particles while permitting pattern decomposition vapors to vent into evacuated plenum 29 during casting.

Pattern 32 includes an engine block pattern 34 sized and shaped corresponding to engine block casting 10. As used herein, portions refer to portions of the pattern corresponding to sections of casting 10. Thus, engine block pattern 34 includes a crankcase portion 36 corresponding to casting crankcase section 12, a cylinder wall portion 38 corresponding to casting cylinder wall section 18, and a jacket wall portion 40 corresponding to casting jacket wall 20. Bores 42 having parallel center axes 43 are defined in cylinder wall portion 38 to shape cylinder bores 24 in the casting 10. Product pattern 34 also includes a surface 44 for forming cylinder head deck 16. As can be seen from the Figures, product pattern 34 is arranged within mold 30 in an inverted position such that cylinder head deck surface 44 represents a lowermost surface of product pattern 34.

Figure 3:
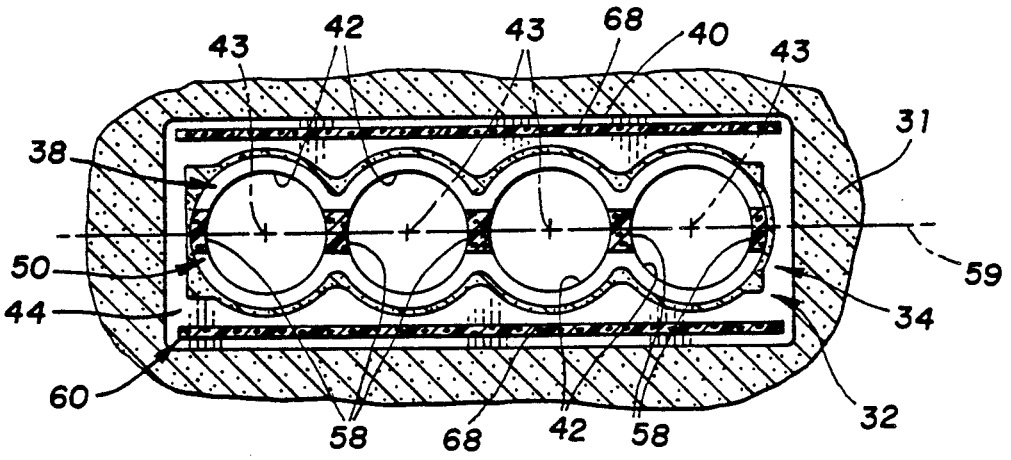
FIG. 3 is a cross-sectional view of a portion of the mold in FIG. 1 taken along the line 3—3 and looking in the direction of the arrows.
Figure 4:
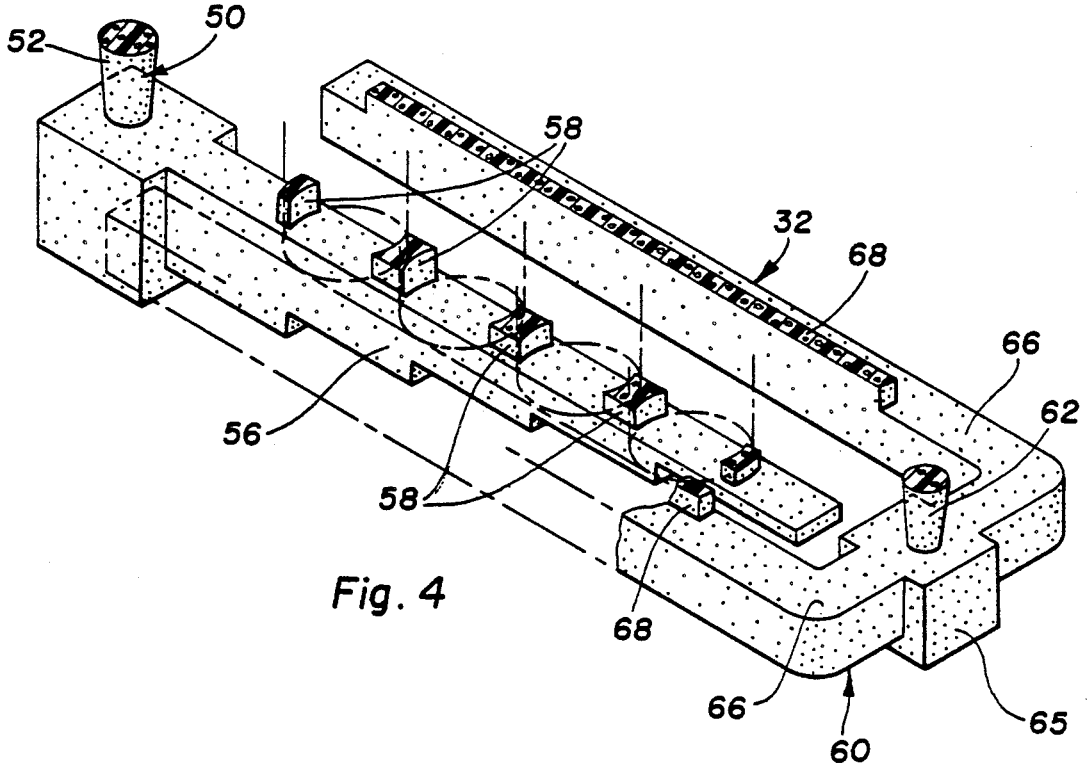
FIG. 4 is a perspective view showing a portion of the runner system for the pattern in FIG. 1, sectioned along the plane of attachment to the product portion.

Pattern 32 further comprises a first runner system 50 also formed of expanded polystyrene material. Runner system 50 comprises a downsprue 52 having a melt pour surface 54 (shown replaced by cast metal) exposed above sand body 31 for admitting molten metal during casting. Downsprue 52 is connected at its lowermost point to a stepped runner 56 that lies adjacent cylinder wall section 38 of product pattern 34 parallel to line 59 corresponding to engine block centerline 25, such that each cylinder bore axis 43 perpendicularly intersects line 59. Stepped runner 56 is connected to cylinder wall portion 38 by a series of aligned ingates 58. As can be seen in FIGS. 3 and 4, ingates 58 connect to cylinder wall section 38 at each interbore site and at sites at the ends of the bore arrangement. In this manner, runner system 50 connects melt pour surface 54 and cylinder wall portion 38. Runner 56 includes steps intermediate ingates 58 for more uniform melt flow through the ingates into cylinder wall portion 38.

Pattern 32 further comprises a second runner system 60 also composed of expanded polystyrene material. Runner system 60 comprises a downsprue 62 having a melt pour surface 64 (shown replaced by metal during casting) exposed above sand body 31 and spaced apart from first runner melt pour surface 54. Downsprue 62 is connected at its lowermost point to a runner 65 comprising branches 66 that extend generally parallel to line 59 on each side of runner 56, but separated by sand mold 31 to prevent intermixing of metals conveyed by the runner systems. Branches 66 lie adjacent water jacket wall portion and are connected thereto by ingates 68. Being formed of decomposable polystyrene, second runner system 60 is thus suitable for conveying metal from melt pour surface 64 to water jacket wall portion 40 of product pattern 34.

Pattern 32 is manufactured by adhesively bonding individually molded polystyrene elements into a singular body. A thin, porous refractory coating, similar to a core wash, is then applied to the exterior surfaces, except melt pour surfaces 54 and 64, to improve casting surface finish and provide thermal insulation during casting to prevent premature metal solidification. Pattern 32 is then positioned within flask while empty, whereafter unbonded sand is rained into the flask, while vibrating gently, to pack the sand about pattern 32 to form the mold. Pour cups 70 and 72 are then placed about melt pour surfaces 54 and 64, respectively, on the surface of sand 31 to direct molten metal into downsprues 52 and 62.

For casting engine block casting 10 in accordance with this invention, a first charge 80 is prepared of a hypereutectic aluminum alloy designated aluminum alloy 390 by the American Society for Metals. A nominal composition for aluminum alloy 390 comprises, by weight, 4 to 5 percent copper, 0.45 to 0.65 percent magnesium, 16 to 18 percent silicon, and the balance aluminum and impurities. Charge 80 is poured from a ladle 82 into pour cup 70 and against melt pour surface 54. Heat from the molten metal decomposes the adjacent polystyrene, whereupon the metal melt flows into the resulting void. In this manner, the molten metal progressively decomposes and replaces downsprue 52, runner 56, and ingates 58 and eventually cylinder wall portion 38. The steps in runner 56 provide more uniform melt flow through ingates 58 despite the varying distances from downsprue 52 and thereby produces more uniform replacement of cylinder wall portion 38.

Following the pouring of the first charge, a second aluminum alloy charge 84 is poured from a ladle 86 into pour cup 72 against melt pour surface 64. The second charge is formed of a hypoeutectic aluminum alloy designated alloy 319 by the American Society for Metals and having a nominal composition of, by weight, 3 to 4 percent copper, 5.5 to 6.5 percent silicon and the remainder aluminum and impurities. In a manner described herein concerning the casting of the first charge, charge 84 progressively decomposes and replaces downsprue 62 and runner 65, including branches 66, and thereafter passes through ingates 68 to replace water jacket wall portion 40. The volume of charge 84 is adjusted to replace not only water jacket wall portion 40, but also crankcase portion 36 and the region of cylinder wall portion 38 adjacent the crankcase portion. That is, charge 84 is sufficient to replace the remainder of pattern 34 not consumed by charge 80. In this manner, the entire pattern is duplicated, whereupon the cast aluminum alloy 319 of charge 84 flows against the cast aluminum alloy 390 of charge 80. At this juncture, shown at 90 in FIG. 6, the two charges fuse together, producing a single body of cast metal.

After cooling and solidifying, the casting is removed from the mold, and sections corresponding to runners 50 and 60 are separated to produce engine block casting 10 shown in FIGS. 5 and 6. As can be seen, piston-travel subsection 26 of cylinder wall section 24 is cast of wear-resistant hypereutectic aluminum alloy 390. The remainder including crankcase section 12 and water jacket wall 20 is cast of hypoeutectic aluminum-silicon alloy 319. The two alloys are fused at 90 such that the resulting casting 10 is an integral metal body.

This engine block casting thus combines the advantages of the hypereutectic alloy in the cylinder wall section and the advantages of the hypoeutectic alloy in the remainder, without the disadvantages of the soft hypoeutectic alloy in the cylinder wall region and the porosity and poor machinability of the hypereutectic alloy in the bulk of the casting.

In the described embodiment, a compound aluminum alloy engine block casting was produced by a lost foam process wherein two charges of compositionally different metal were independently and concurrently cast into the mold to replace a single pattern. The process of decomposing and replacing the polystyrene produces resistance to melt flow not found in empty cavity casting processes. This is accompanied by a controlled fill that allows a relative uniform flow of aluminum alloy 390 into the piston-travel subsection of the cylinder wall section of the casting. It is also accompanied by reduced turbulence and setting of the metal at each melt front that permit the two fronts to flow together with minimal intermixing that would otherwise dilute the desired properties of the individual alloys. In forming the dual alloy engine block casting, the volume of hypereutectic alloy is calculated to replace a predetermined portion of the cylinder wall section. The volume of hypoeutectic alloy is controlled to provide sufficient metal to replace the remainder of the pattern without forcing metal back from subsection 26 into first runner system 50. In the described embodiment, the relative volumes of the cast metal produced a line of fusion within the cylinder wall section. Alternately, the relative volumes may be adjusted to form the line of fusion elsewhere within the product casting. For example, the relative volume of hypereutectic alloy may be increased to consume part of the crankcase portion, whereupon the resulting line of fusion may be formed within the crankcase section.

While the dual alloy casting process of this invention has been disclosed for making a preferred engine block casting, the process is suitable for producing integral castings having configurations intended for other purposes, but which feature distinct sections of dissimilar metals. Also, while in the described embodiment the casting was formed of a combination of hypereutectic aluminum alloy and hypoeutectic aluminum alloy, the method is suitable for casting other combinations of dissimilar aluminum or non-aluminum metals. For example, the method may be adapted for casting different types of iron alloys, such as nodular iron and gray iron. In accordance with this invention, two different alloys are concurrently cast into a singular mold. Both alloys may be simultaneously poured into the mold, or the alloys may be cast in succession, as in the described embodiment. It is preferred to cast the latter charge before the first charge has completely solidified. Typically, the casting of both metals may be completed within a few seconds.

While this invention has been described in terms of certain embodiments thereof, it is not intended that it be limited to the above description, but rather only to the extent set forth in the claims that follow.

The embodiments of the invention in which an exclusive property or privilege is claimed are defined as follows:

1. A lost foam casting process for producing a compound alloy engine block casting, said engine block casting comprising a crankcase section, a cylinder wall section extending from the crankcase section and a water jacket wall also extending from the crankcase section about the cylinder wall section but spaced apart therefrom, said cylinder wall section defining at least one cylinder bore and having a piston-travel region adjacent an outer end remote from the crankcase section, said engine block casting being formed of a plurality of metal alloys such that said cylinder wall piston-travel region is composed of a first alloy and said crankcase section and said water jacket wall are composed of a second alloy, said process comprising embedding in an unbonded particulate mold an expendable pattern comprising a product form substantially sized and shaped to produce the engine block casting and having portions corresponding to the crankcase section, the cylinder wall section and the water jacket wall, said pattern further comprising a first runner system including a melt pour surface and connected to the cylinder wall portion for conveying molten metal from the melt pour surface to the cylinder wall portion, and a second runner system including a melt pour surface distinct from the first runner system melt pour surface and connected to the water jacket wall portion for conveying molten metal from the second runner system melt pour surface to the water jacket wall portion, said pattern being formed of a polymeric material thermally decomposable at metal casting temperatures and embedded in the mold such that the first runner system melt pour surface and the second runner system melt pour surface are exposed and spaced apart for independent contact with cast metal, casting molten first alloy into contact with the first runner system melt pour surface to decompose and replace at least the piston-travel region, concurrently casting molten second alloy into contact with the second runner system melt pour surface to decompose and replace the water jacket wall portion and the crankcase portion, said casting of said alloys continuing so as to decompose and replace the entire pattern, whereupon the alloys flow together, solidifying the cast alloys to form the engine block casting, whereupon the alloys fuse to produce an integral engine block casting, and removing the engine block casting from the mold, and separating runner replacement metal from the engine block casting.

2. A lost foam casting process for producing a compound alloy engine block casting, said engine block casting comprising a crankcase section, a cylinder wall section extending from the crankcase section and a water jacket wall extending from the crankcase section about the cylinder wall section but spaced apart therefrom, said cylinder wall section defining at least one cylinder bore and having a piston-travel region adjacent an outer end remote from the crankcase section, said engine block casting being formed of a plurality of aluminum alloys such that said cylinder wall piston-receiving region is composed of a first aluminum alloy and said crankcase section and said water jacket wall are composed of a second aluminum alloy, said process comprising embedding in an unbonded particulate mold an expanded polystyrene pattern comprising a product form substantially sized and shaped to produce the engine block casting and having portions corresponding to the crankcase section, the cylinder wall section and the water jacket wall, said pattern further comprising a first runner portion including a melt pour surface and connected to the cylinder wall portion for conveying molten metal from the melt pour surface to the cylinder wall portion, and a second runner portion including a melt pour surface distinct from the first runner melt pour surface and connected to the water jacket wall portion for conveying molten metal from the second runner melt pour surface to the water jacket wall portion, said pattern being embedded in the mold such that the first runner melt pour surface and the second runner melt pour surface are exposed and spaced apart for independenf contact with cast metal, casting molten first aluminum alloy into contact with the first runner melt pour surface to decompose and replace at least the piston-travel region, concurrently casting molten second aluminum alloy into contact with the second runner melt pour surface to decompose and replace the water jacket wall portion and the crankcase portion, said casting of said alloys continuing so as to decompose and replace the entire pattern, whereupon the alloys flow together, solidifying the cast alloys to form the engine block casting, whereupon the alloys fuse to produce an integral engine block casting, and removing the engine block casting from the mold.

3. The lost foam casting process in claim 2 wherein the first aluminum alloy is a hypereutectic aluminum-silicon alloy and the second aluminum alloy is hypoeutectic aluminum-silicon alloy.

* * * * *